US007690758B2

(12) United States Patent
Umeda

(10) Patent No.: US 7,690,758 B2
(45) Date of Patent: Apr. 6, 2010

(54) HEAD CLEANING DEVICE

(75) Inventor: Takaichiro Umeda, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 583 days.

(21) Appl. No.: 11/645,373

(22) Filed: Dec. 26, 2006

(65) Prior Publication Data

US 2007/0146424 A1 Jun. 28, 2007

(30) Foreign Application Priority Data

Dec. 27, 2005 (JP) ..... 2005-374389

(51) Int. Cl.
*B41J 2/165* (2006.01)

(52) U.S. Cl. ..... 347/33

(58) Field of Classification Search ..... 347/22, 347/31–34

See application file for complete search history.

(56) References Cited

U.S. PATENT DOCUMENTS 7,004,560 B2 2/2006 Yamada et al.
2002/0140762 A1* 10/2002 Sharma et al. ..... 347/28
2005/0007412 A1* 1/2005 Nishikawa et al. ..... 347/33

FOREIGN PATENT DOCUMENTS

| | | |
|---|---|---|
| JP | 2003039710 | 2/2003 |
| JP | 2003127406 | 5/2003 |
| JP | 2003182088 | 7/2003 |
| JP | 2004-98508 | 4/2004 |
| JP | 2004106280 | 4/2004 |

* cited by examiner

*Primary Examiner*—Julian D Huffman
*Assistant Examiner*—Jason S Uhlenhake
(74) *Attorney, Agent, or Firm*—Eugene Ledonne; Joseph W. Treloar; Frommer Lawrence & Haug LLP

(57) ABSTRACT

A head cleaning device that includes: an ink jet recording head including a nozzle plane formed with nozzles for ejecting ink; a positioning member capable of being brought into contact with an area outside the nozzle plane; and a cleaning roller capable of defining a minute gap between its roller plane and the nozzle plane and capable of rotating while facing the roller plane toward the nozzle plane.

12 Claims, 10 Drawing Sheets

HEAD CLEANING DEVICE

CROSS-REFERENCE TO RELATED APPLICATION

This application claims priority from Japanese Patent Application No. 2005-374389, filed on Dec. 27, 2005, the entire subject matter of which is incorporated herein by reference.

TECHNICAL FIELD

Aspects of the present invention relate to a head cleaning device for removing ink from the nozzle plane of an ink jet recording head for ejecting ink drops from nozzles toward a recording medium.

BACKGROUND

Conventionally, there is an ink-jet system image recording apparatus, which ejects ink drops from an ink jet recording head so as to be applied on a recording sheet thereby recording an image on the recording sheet. In such an ink jet recording apparatus, ink is supplied from an ink chamber for storing ink to an ink jet recording head via a predetermined ink path and the ink is ejected at a prescribed timing from nozzles of the ink jet recording head.

In the image recording apparatus having such an ink jet recording head, in order to remove air bubbles or an alien substance mixed in the ink, cleaning called purging is carried out. The purging refers to sucking the air bubbles or alien substance from the nozzles with the nozzle plane of the ink jet recording head being sealed with a cap and the pressure within the cap being made negative by e.g. a compressing pump.

After purging, ink dispersed within the cap has been deposited on the nozzle plane. Therefore, in order to eject the ink exactly from the nozzles of the ink jet recording head, it is necessary to remove the ink from the nozzle plane. For the purpose of this ink removal, conventionally, a rubber blade called "wiper" has been employed. Specifically, after the ink has been sucked from the ink jet recording head, the cap is taken off. By moving the ink jet recording head with the nozzle plane being in contact with the rubber blade, the rubber blade wipes out the ink deposited on the nozzle plane. The ink removal by such a rubber blade causes the rubber blade to repeatedly slide on the nozzle plane. Thus, a water-repellent layer formed on the nozzle plate may be worn down.

On the other hand, a cleaning mechanism has been proposed in which a sucking tool being not in contact with the nozzle plane of the ink jet recording head is moved to the position having no nozzle while sucking the ink (see JP-A-2003-39710). By this cleaning mechanism, the ink is moved from the vicinity of the nozzles on the nozzle plane so that in the subsequent ink ejection from the nozzles, occurrence of inferior ejection caused by the ink deposited on the nozzle plane is avoided.

Further, as a maintenance device capable of making the ink removal more surely than the rubber blade, a cleaning roller impregnated with a cleaning water has been proposed (see JP-A-2004-106280). The cleaning roller is made of a porous material such as felt and is kept in pressure-contact with the nozzle plane of the ink jet recording head in a state impregnated with a cleaning solution. By moving the ink jet recording head in this state, the cleaning roller can remove the ink deposited on the nozzle plane.

SUMMARY

Even if inferior ink ejection is prevented by moving the ink deposited on the nozzle plane from the vicinity of the nozzles using the sucking tool, as disclosed in JP-A-2003-39710, the ink cannot be removed from the nozzle plane. Therefore, if the recording sheet is brought into contact with the nozzle plane of the ink jet recording head, the recording sheet may be stained with ink. Further, in order to surely move the ink by the sucking force of the sucking tool, it is necessary to match the sucking pressure of the sucking tool with its moving speed relative to the ink jet recording head. In addition, even if they are matched with each other, the relative speed between the sucking tool and the ink jet recording head is as relatively low as about 3 mm/sec. This lengthens maintenance time.

On the other hand, the ink removal using the cleaning roller, as disclosed in JP-A-2004-106280, permits the ink deposited on the nozzle plane of the ink jet recording head to be surely wiped off. However, since the cleaning roller is in pressure-contact with the nozzle plane, abrasion of the repellent layer may occur. In addition, it is necessary to store the cleaning solution such as water or alcohol in the device and further to keep the state of the cleaning roller moistened with the cleaning solution. This is troublesome. Furthermore, the cleaning solution may be left on the nozzle plane. As a result, the cleaning solution deposited on the nozzle plane has to be wiped off by the rubber blade.

Aspects of the present invention provide a device for removing ink from the nozzle plane of the ink jet recording head in non-contact therewith.

According to an aspect of the invention, there is provided a head cleaning device comprising: an ink jet recording head including a nozzle plane formed with nozzles for ejecting ink; a positioning member capable of being brought into contact with an area outside the nozzle plane; and a cleaning roller capable of defining a minute gap between its roller plane and the nozzle plane and capable of rotating while facing the roller plane toward the nozzle plane.

In accordance with the cleaning device, by bringing the positioning member into contact with the area outside the nozzle plane of the ink jet recording head to form a minute gap between the roller plane of the cleaning roller and the nozzle plane, and by rotating the cleaning roller with its roller plane being opposed to the nozzle plane, using the nature of the liquid moving toward the smaller contact angle direction, the ink remaining on the nozzle plane is moved to the roller plane of the cleaning roller. For this reason, the ink remaining on the nozzle plane of the ink jet recording head can be wiped off by the cleaning roller in non-contact with the nozzle plane. Thus, it is possible to prevent the water repellent layer formed on the nozzle plane of the ink jet recording head from being worn down or damaged, thereby lengthening the product life of the ink jet recording head.

DETAILED DESCRIPTION

Now, an explanation will be given of an illustrative aspect of this invention with reference to the accompanying drawings. This illustrative aspect is only an example of this invention. It is needless to say that this illustrative aspect can be appropriately changed within a scope not departing from the spirit of the invention.

Figure 1:
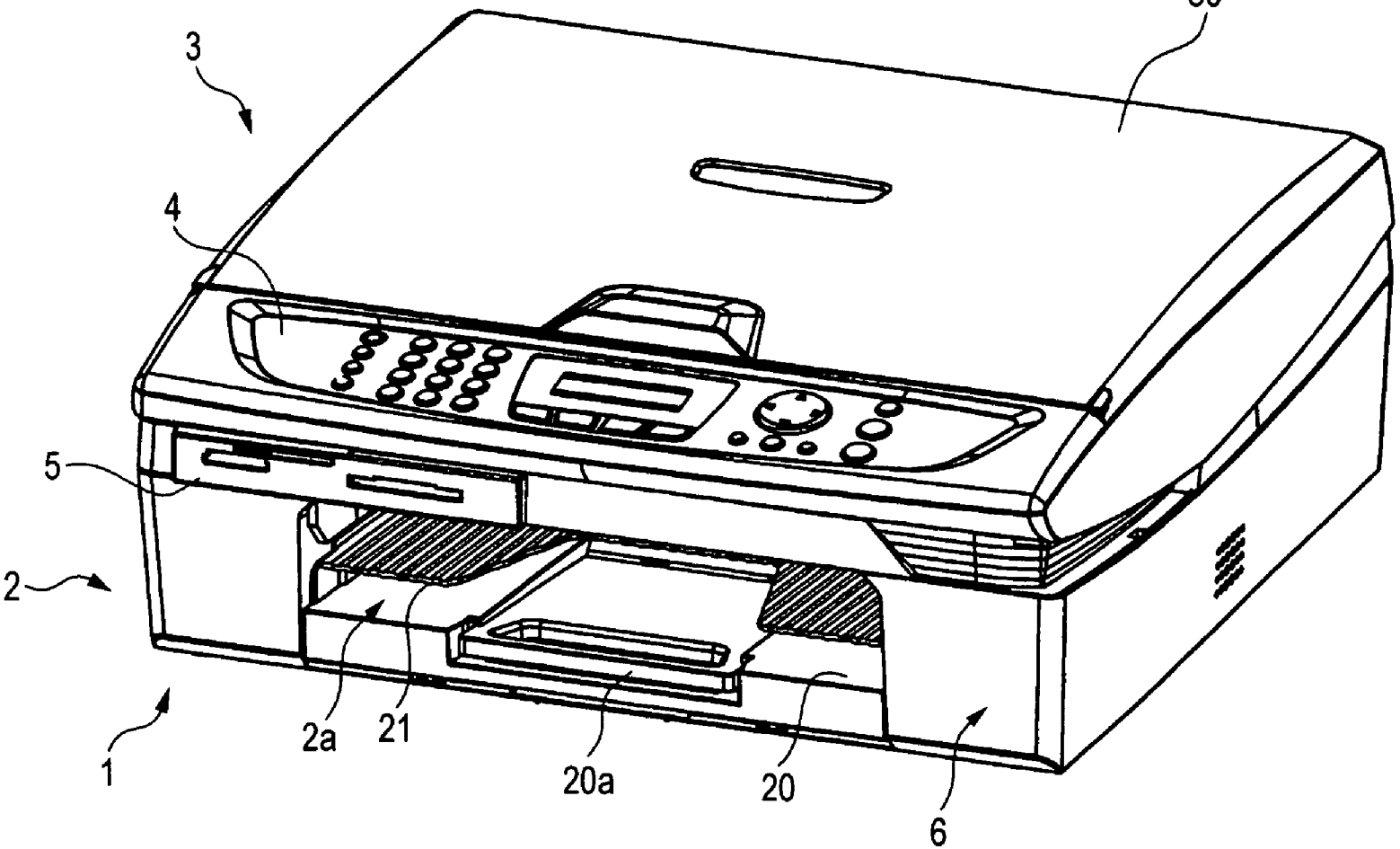
FIG. 1 is a perspective view showing the structure of a multifunction apparatus according to an aspect of this invention.
Figure 2:
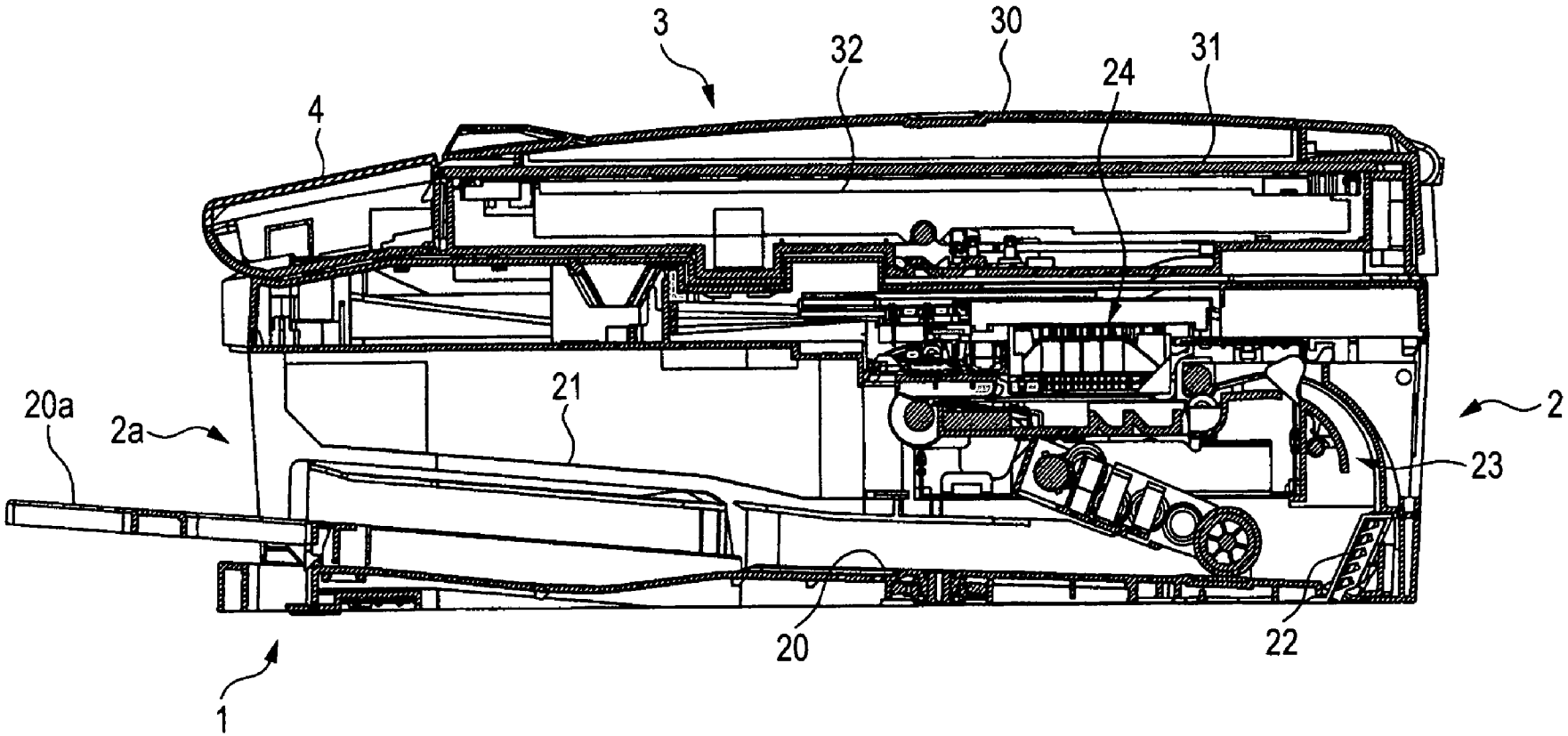
FIG. 2 is a longitudinal cross sectional view showing the internal structure of the multifunction apparatus.
Figure 3:
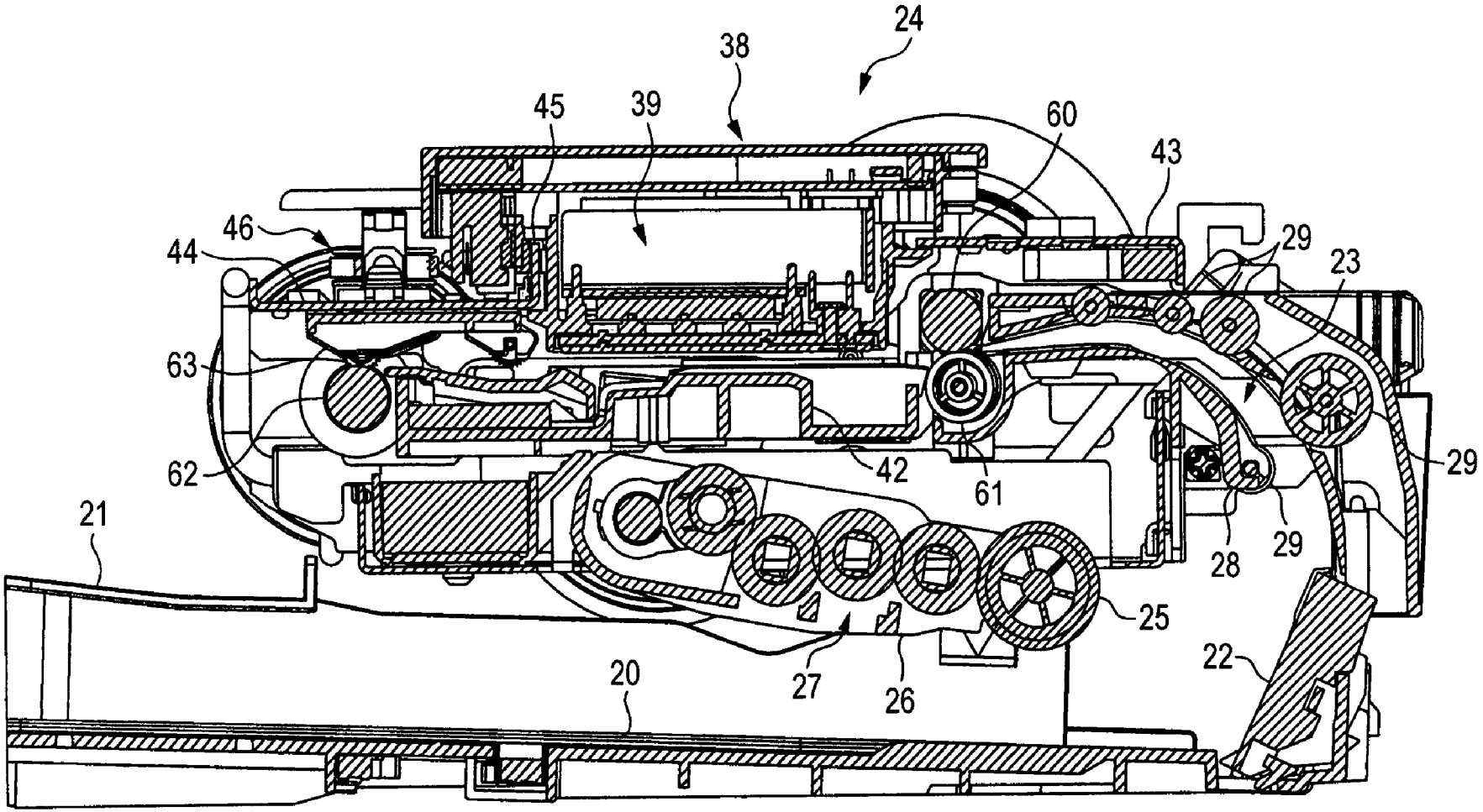
FIG. 3 is an enlarged sectional view showing the arrangement of a printer section.
Figure 4:
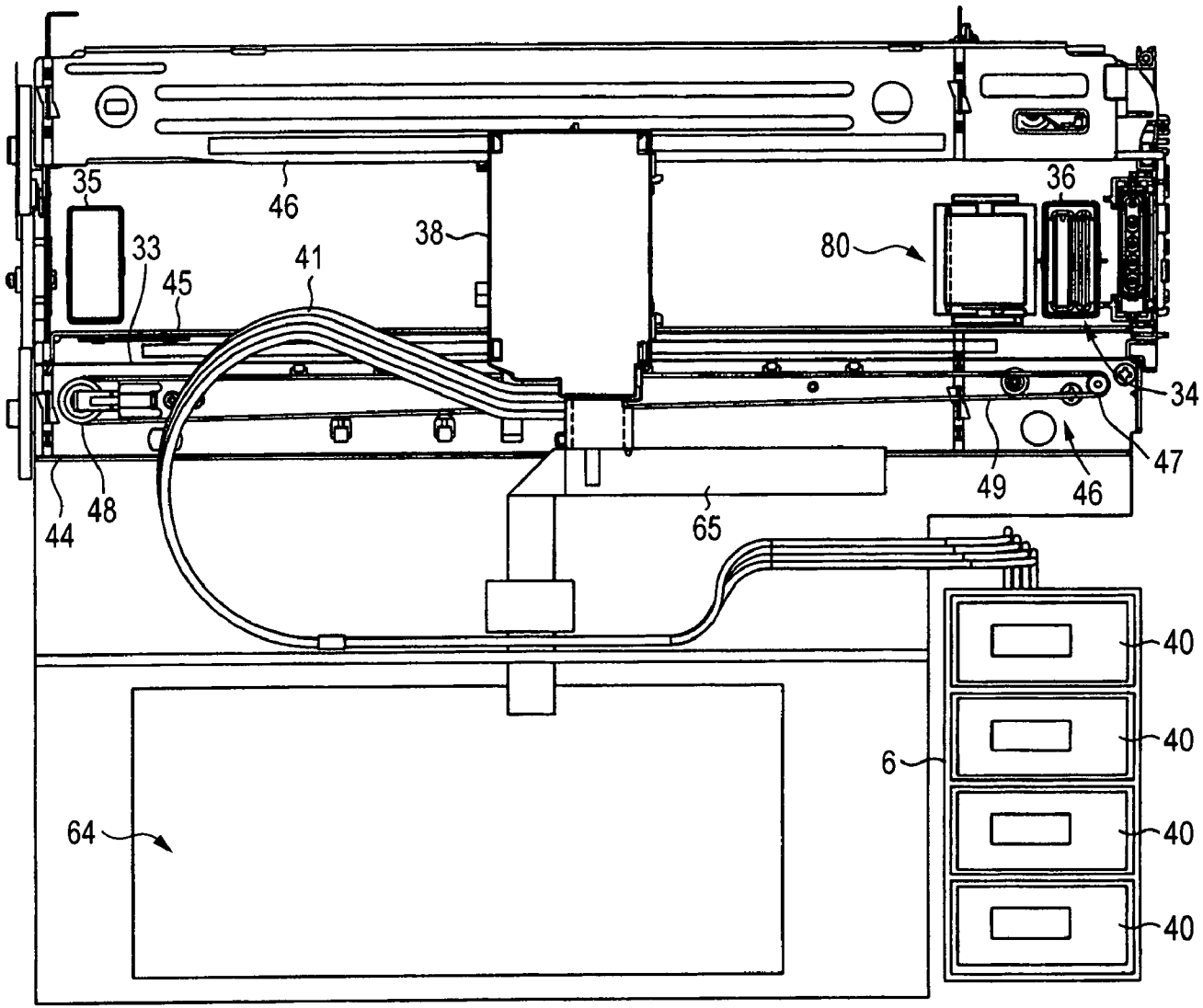
FIG. 4 is an enlarged plan view showing the arrangement of the printer section.

FIG. 1 shows the structure of a multifunction apparatus 1 according to an aspect of this invention. FIG. 2 is a longitudinal cross sectional view showing the internal structure of the multifunction apparatus 1. FIG. 3 is an enlarged sectional view showing the arrangement of a printer section 2. FIG. 4 is an enlarged plan view showing the arrangement of the printer section 2.

As shown in FIG. 1, the multifunction apparatus 1 is a multi function device (MFD: Multi Function Device) including a printer section 2 on the lower side and a scanner section 3 on the upper side which are integrally provided. The multifunction apparatus 1 has a printer function, a scanner function, a copier function and a facsimile function. A head cleaning device is installed in the printer section 2 of the multifunction apparatus 1. Thus, functions other than the printer function of the multifunction apparatus 1 are optional. Therefore, this invention is applicable to a single-function printer without the scanner section 3 and not having the scanner function and copier function.

The multifunction apparatus 1, which is connectable to an external information device such as a computer (not shown), serves to record an image or a document on a recording sheet on the basis of printing data inclusive of image data or document data transmitted from the computer, etc. The multifunction apparatus 1 is also connectable to an external device such as a digital camera and is capable of recording image data outputted from the digital camera on the recording sheet. Further, various recording media such as a memory card may be connected to the multifunction apparatus 1. Thus, the multifunction apparatus can also record image data recorded on the recording medium on the recording sheet. The configuration of the multifunction apparatus 1 described below is an exemplary printer in which the head cleaning device is installed. It is needless to say that the configuration of the multifunction apparatus can be appropriately changed within a scope not departing the spirit of the invention.

As shown in FIG. 1, the multifunction apparatus 1 has a parallelepiped shape in which the lateral width and depth are larger than the height. The lower side of the multifunction apparatus 1 is a printer section 2. The printer section 2 has an opening 2*a* formed on the front. A feed tray 20 and a discharge tray 21 are located at upper and lower two stages in the inside of the opening 2*a* so that a part thereof is exposed from the front of the apparatus. The feed tray 20 serves to store recording sheets which are recoding media and can accommodate the recording sheets with various sizes such as an A4 size, a B5 size and a postal card size. As shown in FIG. 2, a slide tray 20*a* is pulled out as required so that the tray plane is expanded. Thus, the feed tray 20 permits recording sheets with a legal size to be accommodated. The recording sheet accommodated in the feed tray 20 is fed to the inner part of the printer section 2. After a desired image has been recorded, the recording sheet is discharged to the discharge tray 21.

The upper side of the multifunction apparatus 1 is a scanner section 3 which is configured as a so-called flat bed scanner. As shown in FIGS. 1 and 2, on the lower side of a document cover 30 which is openably provided as a top table of the multifunction apparatus 1, a platen glass 31 and an image sensor 32 are located. The platen glass 31 serves to place a document whose image is to be read. Beneath the platen glass 31, the image sensor 32 having a main scanning direction in the depth direction of the multifunction apparatus 1 (lateral direction in FIG. 2) is located movably in the width direction of the multifunction apparatus 1 (direction perpendicular to the sheet of FIG. 2).

On the upper portion of the front of the multifunction apparatus 1, an operating panel 4 for operating the printer section 2 and scanner section 3 is located. The operating panel 4 includes various operating buttons and a liquid crystal display. The multifunction apparatus 1 operates on the basis of an operating command from the operating panel 4. When connected to the computer, the multifunction apparatus 1 also operates on the basis of a command transmitted through a printer driver or scanner driver from the computer. On the upper left portion of the front of the multifunction apparatus 1, a slot 5 in which various small memory cards serving as a recording medium can be loaded is formed. The multifunction apparatus 1 reads out the image data recorded on the small memory card loaded in the slot 5, displays the information on the image data on the liquid crystal display and records a selected image on the recording sheet by the printer section 2. An inputting operation for selecting an image is carried out through the operating panel 4.

As shown in FIG. 2, on the inner side of the feed tray 20 located on the bottom side of the multifunction apparatus 1, a separating slanting plate 22 is located for separating the recording sheets stacked on the feed tray 20 and guiding them upward. A sheet carrying path 23 turns upward from the separating slanting plate 22, curves toward the front side, extends from the rear side of the multifunction apparatus 1 toward the front side and leads to the discharge tray 21 via an image recording unit 24. The recording sheet accommodated in the feed tray 20 is guided to make a U-turn upward from bottom through the sheet carrying path 23 to reach the image recording unit 24 and, after having been subjected to image recording by the image recording unit 24, is discharged to the discharge tray 21.

As shown in FIG. 3, on the upper side of the feed tray 20, a feeding roller 25 is located for separating the recording sheets stacked on the feed tray 20 one by one and feeding the separated recording sheet to the sheet carrying path 23. The feeding roller 25 is pivoted on the tip of a feeding arm 26 which moves up and down relative to the feed tray 20, and is rotated by a driving source such as a motor through a drive transmission mechanism 27 composed of a plurality of gears meshing with one another.

The feeding arm 26 is arranged vertically swingably on an axis of its base side. In the stand-by state, as shown in FIG. 2, the feeding arm 26 is lowered to the lower side by a feeding clutch or a spring and is in contact with the recording sheets accommodated in the feed tray 20. The feeding arm 26, when the feed tray 20 and the discharge tray 21 are pulled out from the opening 2*a*, is caused to move upward. When the feeding roller 25 is rotated in a state where the feeding roller 26 has lowered so that the feeding roller 25 is brought into contact with the surface of the recording sheets on the feed tray 20, the uppermost recording sheet is fed out to the separating slanting plate 22 owing to the frictional force between the roller face of the feeding roller 25 and the recording sheet. The recording sheet is guided with its leading end being in contact with the separating slanting plate 22, and fed into the sheet carrying path 23. When the uppermost recording sheet is fed out by the feeding roller 25, the recording sheet just thereunder may be fed out together by the action of friction or static electricity. However, this recording sheet is stopped in contact with the separating slanting plate 22.

The sheet carrying path 23 is formed by an outer guiding face and an inner guiding face opposed to each other apart by a prescribed interval except the region where the image recording unit 24 is located. For example, the sheet carrying path 23 on the rear side of the multifunction apparatus 1 is configured with its outer guide face being formed integrally to the frame of the multifunction apparatus 1 and the inner guide face being secured in the frame by a guide member 28. In the sheet carrying path 23, particularly at its curving portions, carrying rollers 29 are rotatably provided whose axial direction extends in a widthwise direction of the sheet carrying path 23 so that their roller faces are exposed to the outer guide face or inner guide face. These carrying rollers 29 permit the recording sheet to be smoothly carried at the curving portions of the sheet carrying path 23.

As shown in FIG. 3, the sheet feeding path 23 is provided with the image recording unit 24. The image recording unit 24 has a carriage 38 which incorporates an ink jet recording head 39 and makes a reciprocating motion in the main scanning direction. The ink jet recording head 39 is supplied with respective color inks of cyan (C), magenta (M), yellow (Y) and black (Bk) through ink tubes 41 from ink cartridges 40 (see FIG. 4) which are arranged in the multifunction apparatus 1 separately from the ink jet recording head 39. The ink jet recording head 39 ejects the respective inks as minute ink drops. The carriage 38 incorporating the ink jet recording head 39 makes the reciprocating motion in a direction perpendicular to the carrying direction of the recording sheet. In the means time, the respective inks are selectively ejected at predetermined timings. In this way, a desired image can be recorded on the recording sheet carried on a platen 42.

As shown in FIG. 4, on the upper side of the sheet carrying path 23, a pair of guide rails 43, 44 apart from each other in the carrying direction of the recoding sheet extend in the width direction of the sheet carrying path 23. The carriage 38 is slidably provided astride the guide rails 43, 44. The guide rail 43 located on the upstream side in the carrying direction of the recording sheet is formed of a flat plate whose length in the width direction of the sheet carrying path 23 is longer than the range of the reciprocating motion of the carriage 38 and whose upper face slidably supports the end on the upstream side of the carriage 38.

The guide rail 44 located on the downstream side in the carrying direction of the recording sheet is formed of a flat plate whose length in the width direction of the sheet carrying path 23 is approximately equal to that of the guide rail 43. The edge 45 of the guide rail 44 which supports the end on the downstream side of the carriage 38 is bent upward at a nearly right angle. The carriage 38 is slidably carried on the upper face of the guide rail 44 and sandwiches the edge 45 by rollers. Thus, the carriage 38 is slidably carried on the guide rails 43, 44 and makes the reciprocating motion in the width direction of the sheet carrying path 23 with reference to the edge 45 of the guide rail 44. In the region where the carriage 38 is in contact with the upper surfaces of the guide rails 43, 44, sliding members are appropriately provided for reducing friction.

A belt driving mechanism 46 is arranged on the upper face of the guide rail 44. The belt driving mechanism 46 includes an endless-loop shape timing belt 49 equipped with teeth on the inner side and stretched between a driving pulley 47 and a following pulley 48 which are located in the vicinity of both ends in the width direction of the sheet carrying path 23. The shaft of the driving pulley 47 is supplied with driving force from a driving source such as a motor so that the timing belt 49 makes a circular motion by the rotation of the driving pulley 47. Incidentally, the timing belt 49 may be a terminal-ended belt whose both ends are fixed to the carriage 38, instead of the endless loop-shape belt.

The carriage 38 is fixed to the timing belt 49 and makes the reciprocating motion on the guide rails 43, 44 with reference to the edge 45 by the circular motion of the timing belt 49. The ink jet recording head 39, which is loaded in the carriage 38 constructed as described above, can make the reciprocating motion in the main scanning direction (the width direction of the sheet carrying path 23). On the guide rail 44, an encoder strip 33 of a liner encoder is arranged along the edge 45. The linear encoder serves to decode the encoder strip 33 through a photo-interrupter loaded in the carriage 38. On the basis of a signal detected by the linear encoder, the reciprocating motion of the carriage 38 is controlled.

As shown in FIG. 3, on the lower side of the sheet carrying path 23, a platen 42 is arranged oppositely to the ink jet recording head 39. The platen 42 is arranged over the central zone where the recording sheet passes in the range of the reciprocating motion of the carriage 38. The width of the platen 42 is sufficiently larger than the maximum width of a carryable recording sheet so that both ends of the recording sheet always pass over the platen 42.

As shown in FIG. 4, in the range where the recording sheet does not pass, i.e. outside the range of the image recorded by the ink jet recording head 39, maintenance units such as a purging mechanism 34, a waste ink tray 35 and a head cleaning device 80 are arranged. The purging mechanism 34 serves to suck and remove air bubbles and alien substance from nozzles 51 (see FIG. 5) of the ink jet recording head 39. The purging mechanism 34 includes a cap 36 which covers the nozzles 51 in its intimate contact with the nozzle plane 50 which is a bottom of the ink jet recording head 39; a pumping mechanism connected to the ink jet recording head 39 through the cap 36; and a moving mechanism for bringing the cap 36 into connection/disconnection to the nozzle plane 50 of the ink jet recording head 39. Incidentally, in FIG. 4, the pump mechanism and the moving mechanism are not shown. In sucking and removing the air bubbles from the ink jet recording head 39, the carriage 38 is moved so that the ink jet recording head 39 is located on the cap 36. In this state, the cap 36 is moved upward and brought into intimate contact with the nozzle plane 50 so that the nozzles 51 of the ink jet recording head 39 are sealed. When the pump connected to the cap 36 places the inside of the cap 36 in a negative pressure, the air bubbles and alien substance as well as the ink are sucked and removed from the nozzles 51 of the ink jet recording head 39.

The waste ink tray 35 serves to receive idle ink ejection called "flushing" from the ink jet recording head 39. The waste ink tray 35 is located within the range of the reciprocating motion of the carriage 38 and outside the range of image recording. The waste ink tray 35 may be realized, for example, as a part of the platen 42.

The head cleaning device 80 is arranged adjacently to the purging mechanism 34. The head cleaning device 80 serves to clean the nozzle plane 50 of the ink jet recording head 39 from which the ink has been sucked by the purging mechanism 34. The configuration of the head cleaning device 80 will be described later in detail. By means of these maintenance units, maintenance such as removal of the air bubbles and mixed inks in the ink jet recording head 39 is carried out.

The ink cartridges 40, as shown in FIGS. 1 and 4, are loaded in a cartridge loading unit 6 provided in a box located left sideward on the front side of the printer section 2 (right side in the figure). As shown in FIG. 4, the cartridge loading unit 6 is arranged separately from the carriage 38 incorporating the ink jet recording head 39. The respective color inks of cyan (C), magenta (M), yellow (Y) and black (Bk) are supplied through the ink tubes 41 to the carriage 38 from the corresponding ink cartridges 40 loaded in the cartridge loading unit 6.

The respective color inks are supplied from the corresponding ink cartridges 40 to the ink jet recording head 39 through the ink tubes 41 independent for the respective colors. The ink tubes 41 are formed of tubes made of synthetic resin and have flexibility to warp according to the reciprocating motion of the carriage 38.

The respective ink tubes 41 led from the cartridge loading unit 6 are pulled out to the vicinity of the center of the device along the width direction thereof and once secured to an appropriate member such as a frame. Its part from the securing position to the carriage 38 is not secured to the frame so that the posture changes so as to follow the reciprocating motion of the carriage 38. Specifically, as the carriage 38 moves to the one end (left side of the figure) in the direction of the reciprocating motion, the respective ink tubes 41 move in the moving direction of the carriage 38 while they warp so as to increase their bending radius of a U-shape curved segment. On the other hand, as the carriage 38 moves to the other end (right side of the figure) in the direction of the reciprocating motion, the respective tubes 41 move in the moving direction of the carriage 38 while they warp so as to decrease their bending radius of a U-shape curved segment.

Figure 5:
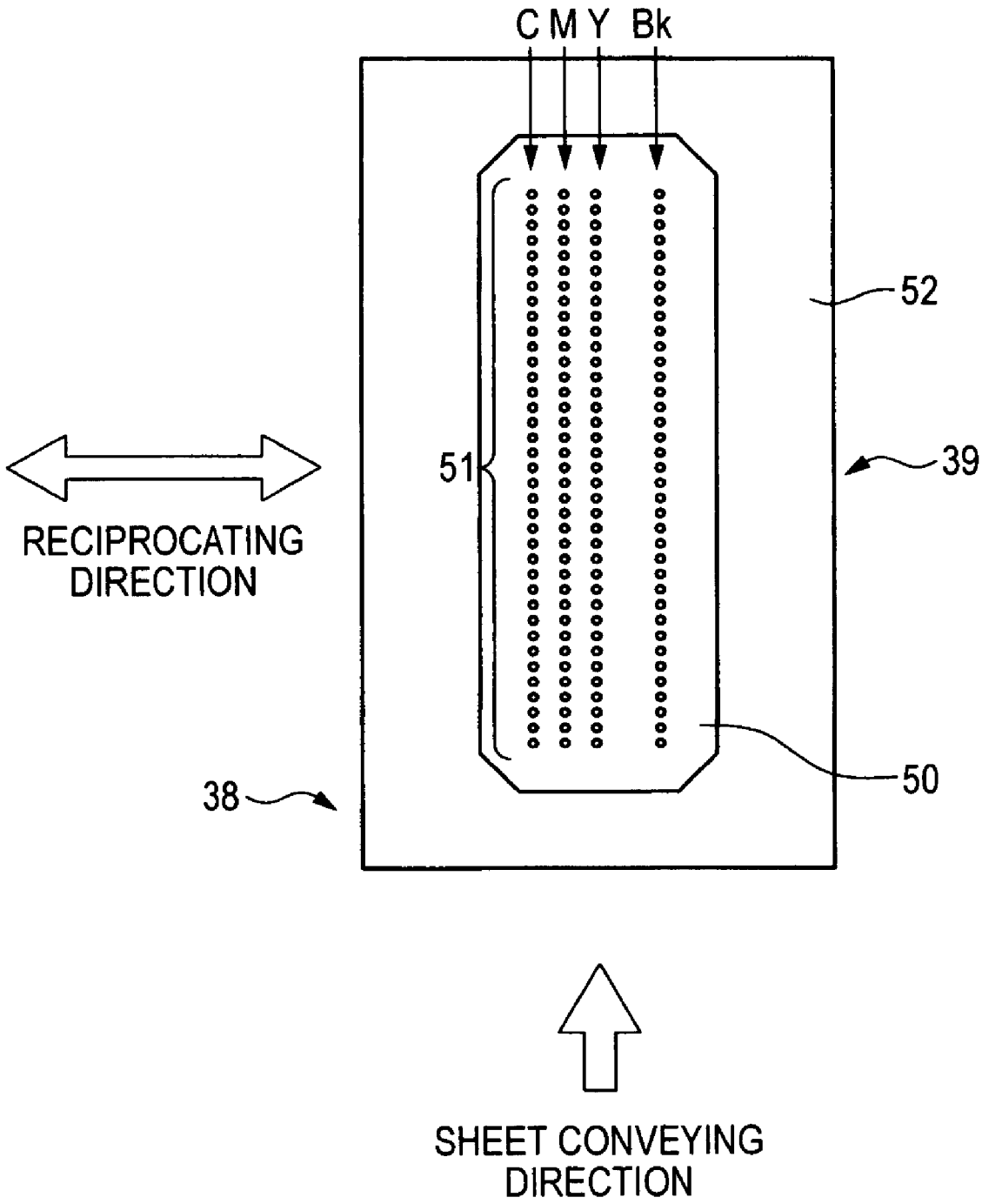
FIG. 5 is a bottom view of an ink jet recording head.

FIG. 5 is a bottom view of the ink jet recording head 39. The ink jet recording head 39 has the nozzles 51 for ejecting ink arranged on the nozzle plane 50, which is a bottom of the ink jet recording head 39. The nozzles 51 are arranged in columns for the respective color inks of C, M, Y and Bk in the carrying direction of the recording sheet. The nozzle plane 50 is formed nearly centrally on the lower surface of the ink jet recording head 39. On the surface thereof, a water repellent layer such as a Teflon (trademark) layer is formed. At the peripheral edge of the nozzle plane 50, i.e. outside the area of the nozzle plane 50, a cover plate 52 is arranged. The cover plate 52 is an area with which a contact roller 81 of the head cleaning device 80 described later is brought into contact. The cover plate 52 is made of e.g. abrasion-resistant resin. It should be noted in the figure that the vertical direction is the carrying direction of the recording sheet and the horizontal direction is the direction of the reciprocating motion of the carriage 38. The columns of the nozzles 51 of the respective colors of C, M, Y and Bk are arranged in the reciprocating direction of the carriages 38. The pitch and number of the nozzles 51 in the carrying direction are appropriately set considering the resolution of the recorded image and others. Further, according to the number of kinds of the color inks, the number of the columns of the nozzles 51 can be increased/decreased.

Figure 6:
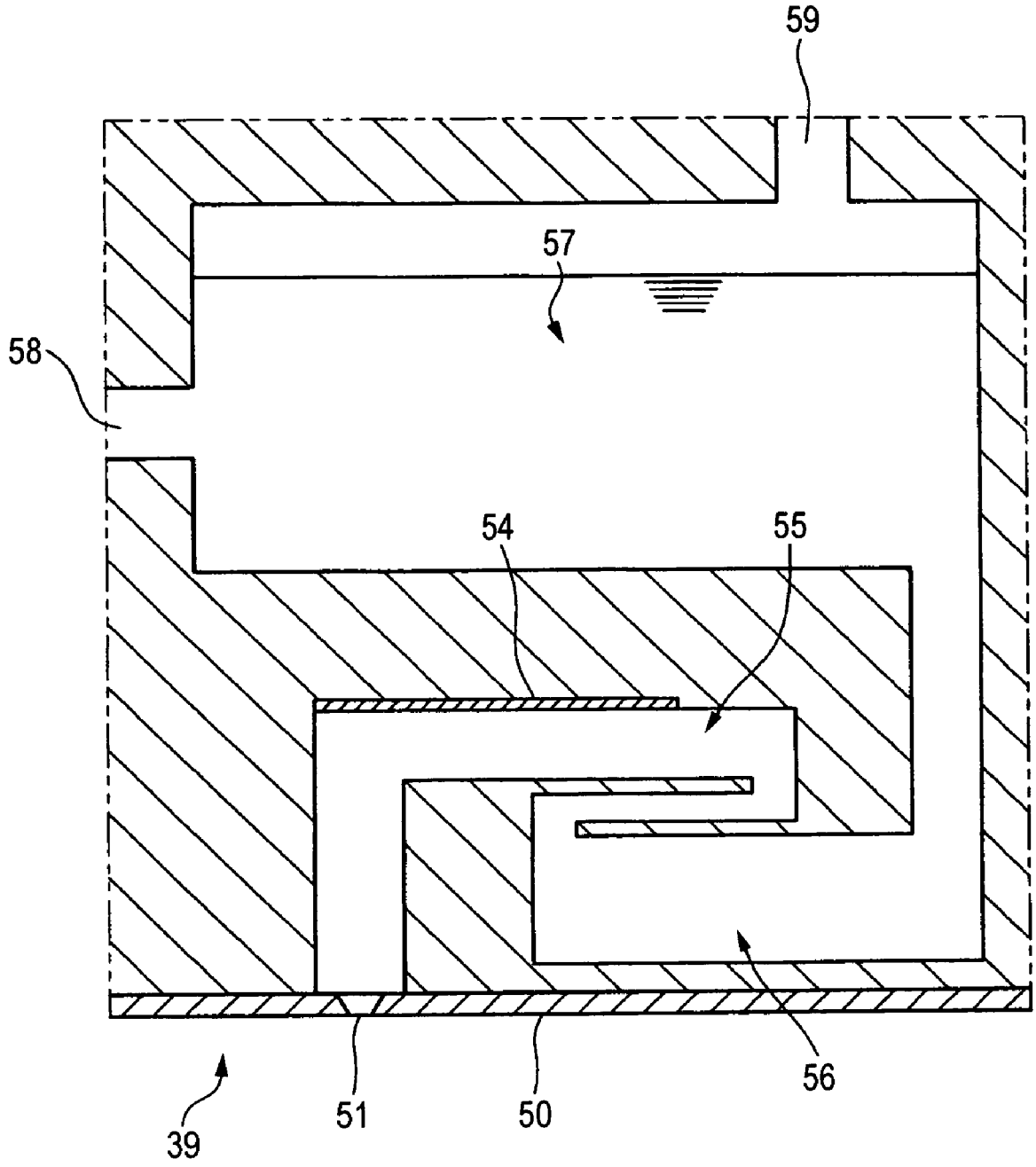
FIG. 6 is a sectional view showing the internal structure of the ink jet recording head.

FIG. 6 is a sectional view of the internal configuration of the ink jet recording head 39. On the upstream side of the nozzle 51, which is formed so as to open in the nozzle plane 50 of the ink jet recording head 39, a cavity 55 equipped with a piezoelectric element 54 is formed. The piezoelectric element 54 is deformed when a predetermined voltage is applied, thereby reducing the volume of the cavity 55. Owing to changes in the volume of the cavity 55, the ink within the cavity 55 is ejected as ink drops from the nozzle 51.

The cavity 55 is prepared for each of the nozzles 51. A manifold 56 is formed over the plurality of cavities 55 in the column of the nozzles 51 for each color. On the upper side of the manifold 56, a buffer tank 57 is arranged. The buffer tank 57 is prepared for each color of C, M, Y, Bk. Each buffer tank 57 is supplied with ink through an ink supplying mouth 58 from the ink cartridge 40 via the ink tube 41. Since the ink once stored is retained in the buffer tank 57, the air bubbles generated in the ink in the ink tube 41 are trapped. Thus, it is possible to prevent the air bubbles from entering the cavity 55 and the manifold 56. The air bubbles trapped within the buffer tank 57 are removed from an air bubble exhausting mouth 59 by the pump mechanism. The ink supplied from the buffer tank 57 to the manifold 56 is distributed to each cavity 55 by the manifold 56.

Ink passages are formed such that the respective color inks are supplied from the ink cartridges 40 through the ink tubes 41 and flow to the cavities 55 through the buffer tanks 57 and manifolds 56. The respective color inks of C, M, Y, Bk supplied through these ink passages are ejected as ink drops toward the recording sheet from the nozzles 51.

As shown in FIG. 3, on the upstream side of the image recording unit 24, a pair of carrying roller 60 and pressing roller 61 are provided which carry the recording sheet onto the platen 42 while sandwiching the recording sheet being carried along the sheet carrying path 23. On the downstream side of the image recording unit 24, a pair of discharge roller 62 and spur roller 63 are provided which carry the recorded recording sheet while sandwiching it. The carrying roller 60 and the discharge roller 62 are driven by drive transmission from the driving source such as a motor so that they are intermittently driven with a predetermined linefeed width. The carrying roller 60 and the discharge roller 62 are synchronously rotated so that the rotary encoder mounted in the carrying roller 60 detects the encoder disk rotating together with the carrying roller 60 using a photo-interrupter. On the basis of the detected signal, the rotation of the carrying roller 60 and discharge roller 62 is controlled.

The pressing roller 61 is urged so as to be pressed on the carrying roller 60 by predetermined pressing force and rotatably provided. Where the recording sheet enters between the carrying roller 60 and the pressing roller 61, the pressing roller 61 retreats by the thickness of the recording sheet and sandwiches the recording sheet together with the carrying roller 60. Thus, the rotating force of the carrying roller 60 can be surely transmitted to the recording sheet. The spur roller 61 is also likewise prepared for the discharge roller 62. Since it is in pressure-contact with the recorded recording sheet, its roller plane is rugged in a spur shape so as to prevent the image recorded on the recording sheet from being deteriorated.

As shown in FIG. 4, a recording signal and others are transmitted from a main substrate 64 to the ink jet recording head 39 through a flat cable 65. The main substrate 64 constitutes a control unit for controlling the operation of the multifunction apparatus 1. The flat cable 65 is formed of a thin band-like cable insulated by covering a conductor for transmitting an electric signal with synthetic resin such as polyester. The flat cable 65 electrically connects the main substrate 64 to the control substrate of the ink jet recording head 39.

The flat cable 65 is led out in the reciprocating direction from the carriage 38 and vertically bent in a nearly U-shape. This U-shape segment is not secured so that its posture changes to follow the reciprocating motion of the carriage 38.

Figure 7:
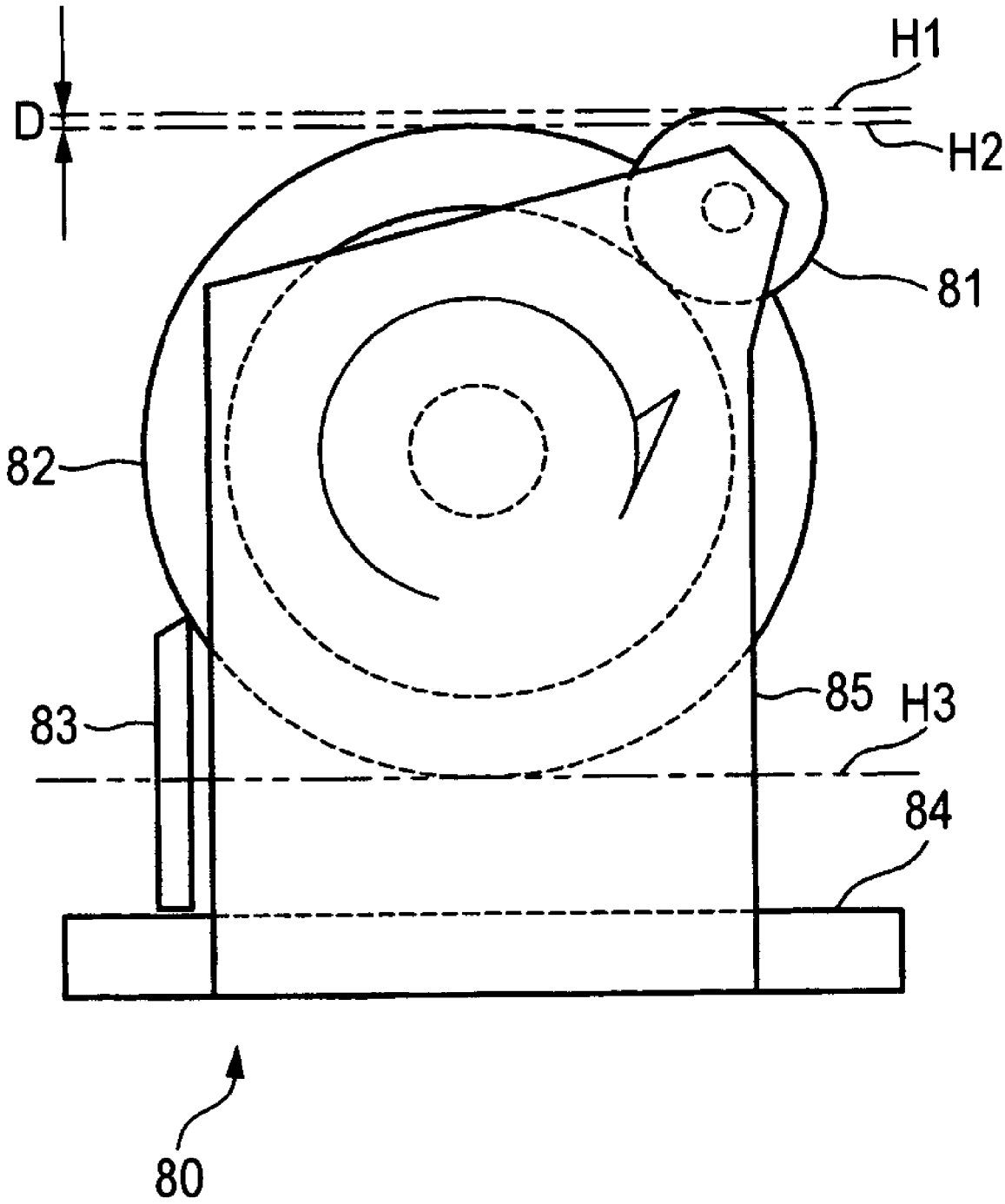
FIG. 7 is a front view schematically showing the structure of a head cleaning device.
Figure 8:
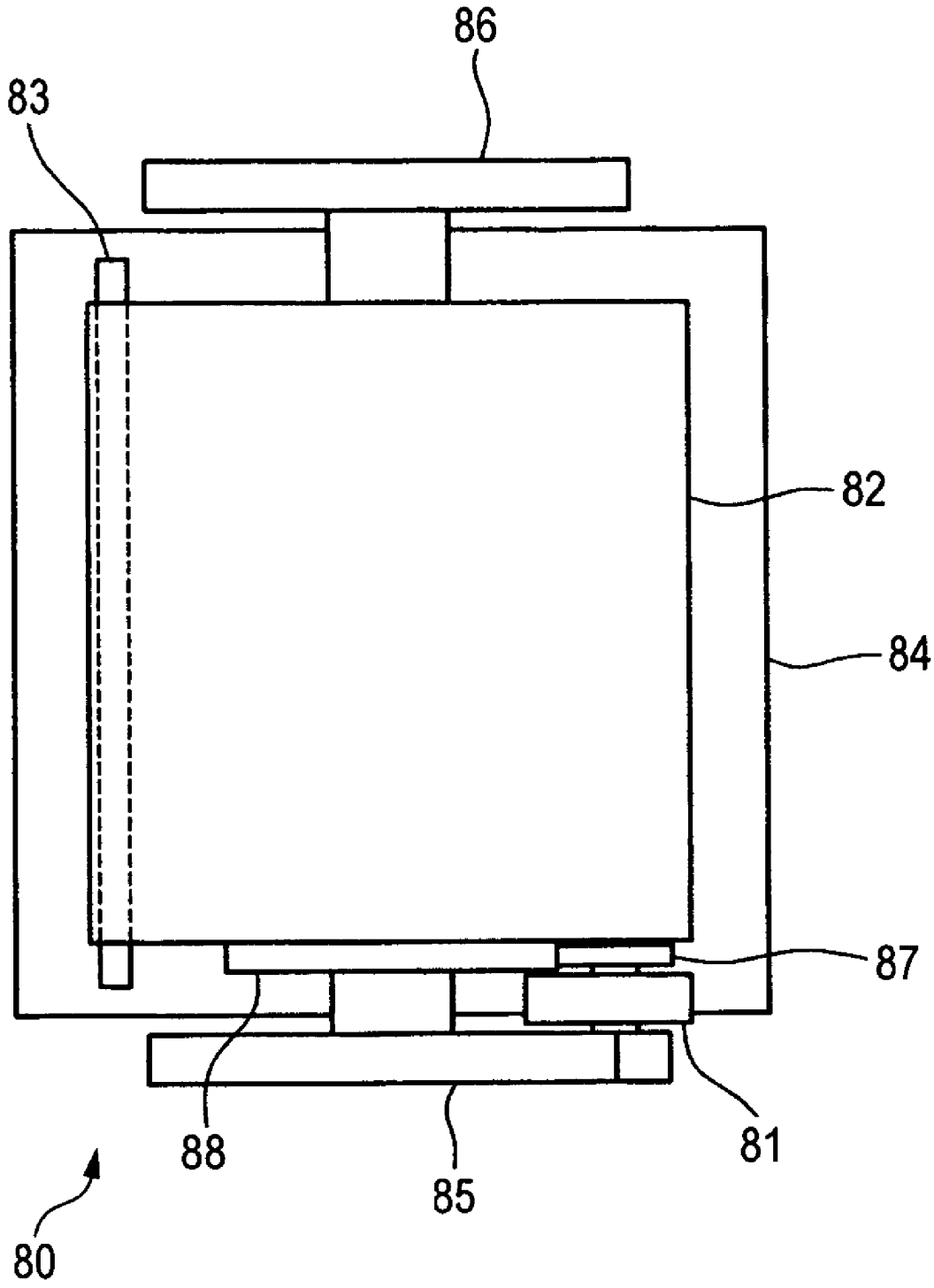
FIG. 8 is a plan view schematically showing the structure of the head cleaning device.

The head cleaning device 80 will be described below. FIG. 7 is a front view showing the structure of the head cleaning device 80. FIG. 8 is a plan view showing the structure of the head cleaning device 80. The head cleaning device 80, as shown in FIG. 4, is arranged outside the range of image recording within the range of the reciprocating motion of the carriage 38 on the guide rails 43, 44. The head cleaning device 80 is arranged inside the purging mechanism 34. By means of this head cleaning device 80, the deposited ink is removed from the nozzle plane 50 of the ink jet recording head 39 which has been subjected to ink sucking by the purging mechanism 34.

As shown in FIGS. 7 and 8, the head cleaning device 80 includes a contact roller 81 (positioning member) in contact with the nozzle plane 50 of the ink jet recording head 39, a cleaning roller 82 for removing the ink deposited on the nozzle plane 50, a cleaning blade 83 (cleaning member) for cleaning the roller plane of the cleaning roller 82, and a waste ink foam 84 for absorbing the removed ink and keeping it.

The contact roller 81 is rotatably supported by one of a pair of supporting frames 85, 86. The supporting frames 85, 86 rotatably support the cleaning roller 82. The supporting frames 85, 86 are arranged at opposite positions apart from each other in the axial direction of the cleaning roller 82. The distance between the supporting frames 85, 86 is slightly wider than the length in the recording sheet carrying direction of the inkjet recording head 39. Thus, the inkjet recording head 39 making the reciprocating motion together with the carriage 38 on the guide rails 43, 44 passes above between the supporting frames 85, 86. The direction in which the supporting frames 85, 86 are opposed to each other is the carrying direction of the recording sheet, which is the vertical direction in FIG. 4. The bases of the supporting frames 85, 86 are secured to the apparatus body or frame member of the multifunction apparatus 1. The supporting frames 85, 86 may be ribs formed integrally with the frame member.

The contact roller 81, as seen from FIG. 8, is supported in the vicinity of the upper end of the supporting frame 85 on the downstream side in the carrying direction of the recording sheet so that its axial direction is aligned with the carrying direction. As shown in FIG. 7, the upper end position H1 of the roller plane of the contact roller 81 is an uppermost position of the head cleaning device 80. The upper end position H1 of the roller plane of the contact roller 81 is set so as to agree with the height of the nozzle plane 50 of the ink jet recording head 39 loaded in the carriage 38 and making the reciprocating motion. Further, the contact roller 81, when seen from above, is arranged so as to correspond to the downstream side in the carrying direction of the cover plate 52 of the ink jet recording head 39. Therefore, the cover plate 52 outside the range of the nozzle plane 50 in the ink jet recording head 39 making the reciprocating motion together with the carriage 38 is in contact with the roller plane of the contact roller 81. The length in the axial direction of the contact roller 81 is set to stay within the area of the cover plate 52 so that the contact roller 81 is not incontact with the area of the nozzle plane 50, i.e. the area where the water repellent layer is formed.

As shown in FIG. 8, the cleaning roller 82, with its axial direction being aligned with the carrying direction of the recording sheet, is rotatably provided between the supporting frames 85, 86. As seen from FIG. 7, the upper end position H2 of the roller plane of the cleaning roller 82 is set to be slightly lower than the upper end position H1 of the roller plane of the contact roller 81. The difference between the upper end position H1 of the roller plane of the contact roller 81 and the upper end position H2 of the roller plane of the cleaning roller 82 corresponds to a minute gap D between the roller plane of the cleaning roller 82 and the nozzle plane 50 of the ink jet recording head 39. This minute gap D is preferably within a range of 0.01 to 0.1 mm in order to remove the ink deposited on the nozzle plane 50, more preferably within a range of 0.03 to 0.05 mm. The length of the cleaning roller 82 corresponds to that of the nozzle plane 50 of the ink jet recording head 39 so that the nozzle plane 50 and the roller plane of the cleaning roller 82 are opposed to each other.

The cleaning roller 82 is preferably more hydrophilic than the nozzle plane 50 of the ink jet recording head 39. By making the roller plane of cleaning roller 82 more hydrophilic, a contact angle of the roller plane with the ink can be surely made smaller than the contact angle of the nozzle plane 50 with the ink. Specifically, in contrast to the nozzle plane 50 on which the water-repellent layer of Teflon (trade mark) is formed, the roller plane of the cleaning roller 82 is preferably made of a metallic material of e.g. stainless steel (SUS), aluminum, or free cutting carbon steels (SUM); resin material of polyacetal resin (POM), acryl-butadiene-styrene (ABS), polypropylene resin (PP), polybutyleneterephthalate resin (PBT), polyethylene resin (PE) or polycarbonate resin (PC); or these materials subjected to water-affinity treatment such as ozone treatment or plasma treatment.

The axis of the contact roller 81 has a driving gear 87 and the axis of the cleaning roller 82 has a driven gear 88. The driving gear 87 and the driven gear 88 are tooth-engaged with each other so that the rotation of the contact roller 81 is transmitted to the cleaning roller 82 as a reverse rotation. The driving gear 87 and driven gear 88 correspond to a drive transmission member. The drive transmission member should not be limited to a chain of gears, but may be a known structure permitting drive transmission such as a timing belt. Since the driving gear 87 and the driven gear 88 are provided, it is not necessary to transmit the driving force from the driving source such as a motor to the cleaning roller 82. Thus, the head cleaning device 80 can be realized in a simple structure. It is needless to say that the drive transmission from the driving source such as a motor to the cleaning roller 82 can be done thereby to rotate the cleaning roller 82. In this case, it is not necessary to provide the driving gear 87 and the driven gear 88.

Below the cleaning roller 82, the waste ink foam 84 is laid. The waste ink foam 84 is a water-absorptive material such as felt and widely covers the region below the cleaning roller 82. The ink removed from the nozzle plane 50 of the ink jet recording head 39 is downward thrown off y the rotation of the cleaning roller 82 and absorbed in the waste ink foam 84, thereby being recovered.

At a position on the downstream side in the rotating direction of the cleaning roller 82 relative to the waste ink foam 84, a cleaning blade 83 is arranged. Namely, the cleaning blade 83 is arranged on the downstream side in the rotating direction of the cleaning roller 82 with respect to the lowermost position H3 of the roller plane of the cleaning roller 82. The cleaning blade 83 is formed of a wiper-like rubber member. In this way, the wiper-like elastic member which is in slidable-contact with the roller plane of the cleaning roller 82 to wipe up the ink is referred to as the blade. As seen from FIG. 7, the tip of the cleaning blade 83 is in pressure-contact with the entire area in the axial direction of the roller plane of the cleaning roller 82. The cleaning roller 82 is rotated with the cleaning blade 83 being in pressure-contact therewith so that the ink deposited on the roller plane is wiped up by the cleaning blade 83, and thrown off onto the waste ink foam 84. Thus, the ink on the roller plane of the cleaning roller 82 can be surely removed.

Now referring to FIGS. 9A to 9C and FIG. 10, an explanation will be given of cleaning of the nozzle plane 50 of the ink jet recording head 39 by means of the cleaning device 80. When the power source of the multifunction apparatus 1 is turned on, or at predetermined time intervals, the ink jet recording head 39 is subjected to the sucking of ink (purging) by the purging mechanism 34 in order to prevent clogging in the nozzles 51 and remove the air bubbles. In purging, the carriage 38 is moved onto the cap 36 (see FIG. 4) so that the nozzle plane 50 of the ink jet recording head 39 is covered and sealed with the cap 36. In this state, the inside of the cap 36 is placed in the negative pressure by the pump so that ink is sucked from the respective nozzles 51.

Upon completion of the purging, the inside of the cap 36 is restored to normal pressure so that the cap 36 is separated from the nozzle plane 50. After the purging, a part of the ink sucked is dispersed and deposited on the nozzle plane 50. The ink jet recording head 39 with the ink being deposited on the nozzle plane 50 is moved together with the carriage 38 toward the head cleaning head 80 on the guide rails 43, 44.

Figure 9A:
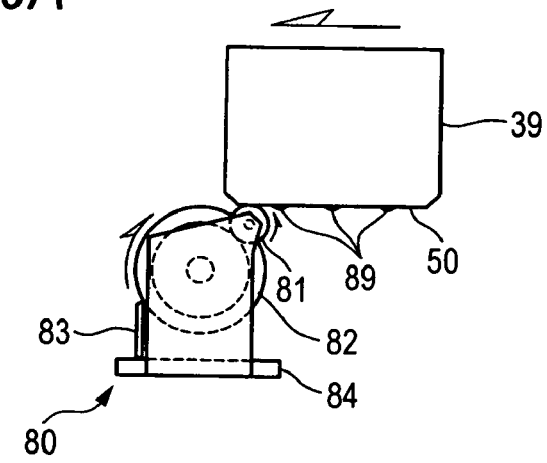
FIGS. 9A to 9C are views showing the cleaning operation by the head cleaning device.
Figure 9B:
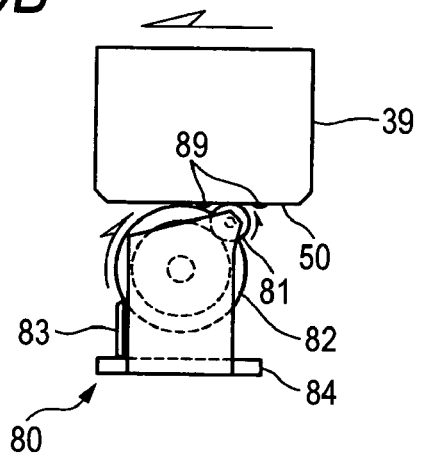

As shown in FIG. 9A, the cover plate 52 (see FIG. 5) of the ink jet recording head 39 moved to the head cleaning device 80 is brought into contact with the contact roller 81 of the head cleaning device 80. With the cover plate 52 being in contact with the contact roller 81, the ink jet recording head 39 is further moved. Thus, as the ink jet recording head 39 moves, the contact roller 81 rotates counterclockwise in FIG. 9A.

The rotation of the contact roller 81 is transmitted to the cleaning roller 82 through the driving gear 87 and the driven gear 88. Thus, if the contact roller 81 rotates counterclockwise in FIG. 9A, the cleaning roller 82 rotates clockwise in FIG. 9A. Namely, the nozzle plane 50 which is the bottom of the ink jet recording head 39 and the roller plane of the cleaning roller 82 move in opposite directions.

The upper end position H2 of the roller plane of the cleaning roller 82 is slightly lower than the upper end position H1 of the roller plane of the contact roller 81. Therefore, in the state shown in FIG. 9B, the nozzle plane 50 of the ink jet recording head 39 moving in contact with the roller plane of the contact roller 81 is not brought into contact with the roller plane of the cleaning roller 82 so that the minute gap D is kept between the nozzle plane 50 of the ink jet recording head 39 and the roller plane of the cleaning roller 82.

The ink drops 89 deposited on the nozzle plane 50 of the ink jet recording head 39 become hemispherical so as to swell owing to their surface tension downward from the nozzle plane 50. The size of the ink drops 89 swelling downward is larger than the minute gap D between the nozzle plane 50 and the roller plane of the cleaning roller 82. Thus, although the nozzle plane 50 of the ink jet recording head 39 is not brought into contact with the roller plane of the cleaning roller 82, the ink drops 89 deposited on the nozzle plane 50 are brought into contact with the roller plane of the cleaning roller 82. This results in the state where the ink drops 89 intervene between the nozzle plane 50 and the roller plane.

Figure 10:
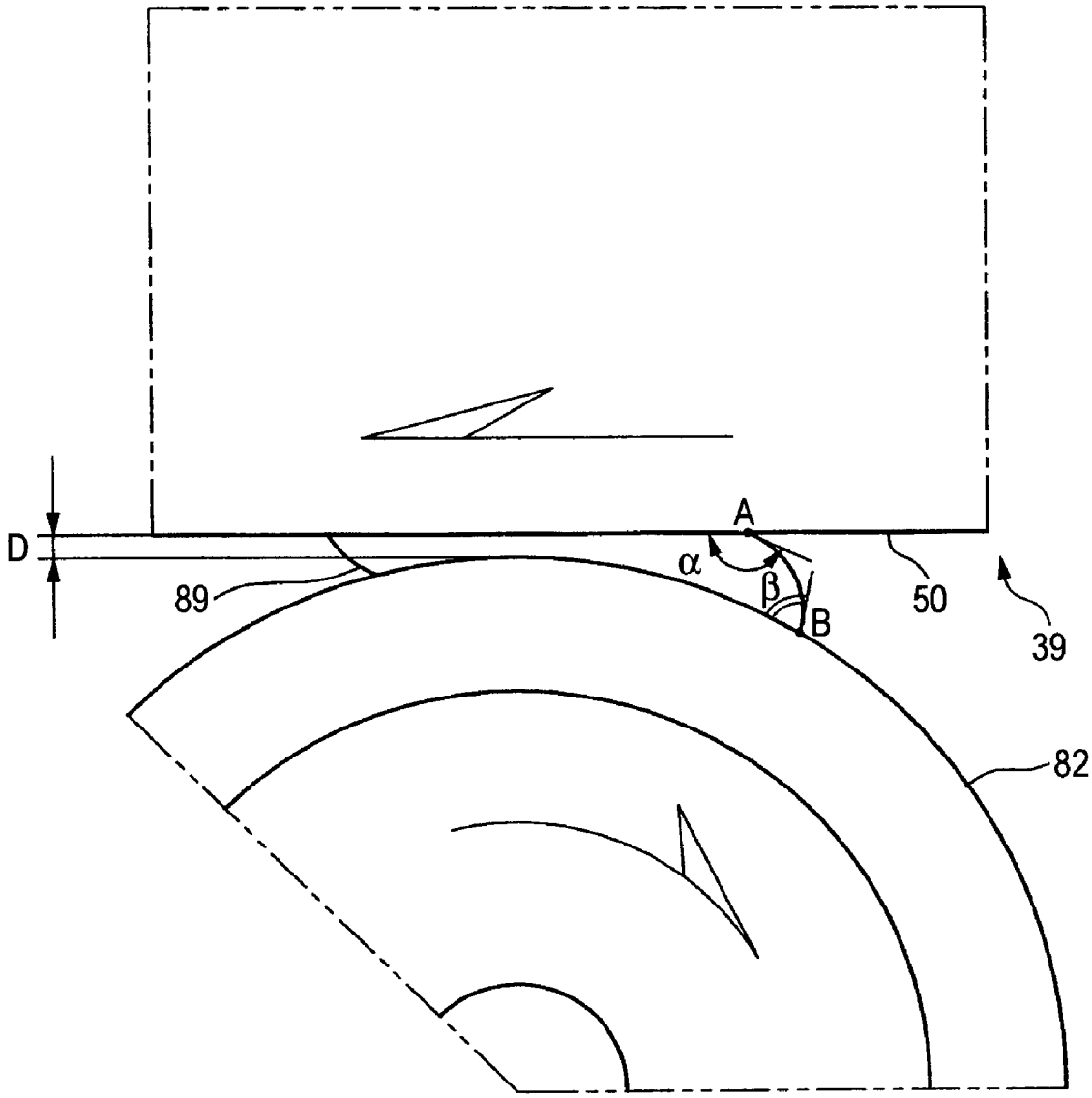
FIG. 10 is a view showing the cleaning operation by the head cleaning device.

FIG. 10 shows the state where the ink moves from the nozzle plane 50 to the roller plane of the cleaning roller 82. In the state where the ink drop 89 intervenes between the nozzle plane 50 and the roller plane of the cleaning roller 82, when attention is paid to the advancing direction of the roller plane, i.e. the rightward direction in FIG. 10, at a contact point A between the ink drop 89, the nozzle plane 50 and outside air, and a contact point B between the ink drop 89, roller plane of the cleaning roller 82 and outside air, there are contact angles $\alpha$ and $\beta$. Now, the contact angle refers to the angle formed between the tangential line drawn on the liquid surface and solid surface on the side including the liquid at the contact point between three phases of a solid (nozzle plane 50, roller plane), a liquid (ink drop 89) and a gas (outside air).

The roller plane of the cleaning roller 82 moves rightward relatively to the nozzle plane 50 in FIG. 10. For this reason, the ink drop 89 is deformed so as to be pulled by the roller plane of the cleaning roller 82 being more hydrophilic than the nozzle plane 50. Thus, the contact angle $\alpha >$ the contact angle $\beta$. On the other hand, from the nature of the liquid, the ink drop 89 moves so that the contact angles $\alpha$ and $\beta$ become equal. As a result, the ink drop 89 moves in the direction in which the contact angle $\alpha$ decreases and the contact angle $\beta$ increases, i.e. from the nozzle plane 50 to the roller plane of the cleaning roller 82. Accordingly, the ink drops 89 deposited on the nozzle plane 50 move to the roller plane of the cleaning roller 82.

Figure 9C:
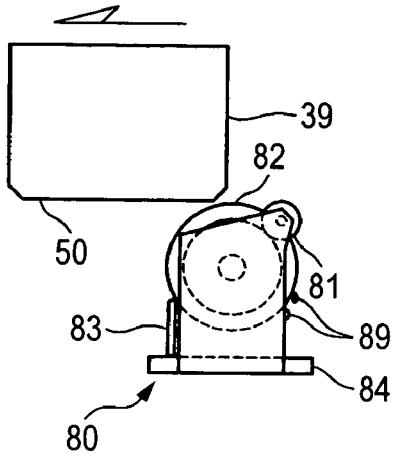

As shown in FIG. 9C, the ink drops 89 moved to the roller plane of the cleaning roller 82 fly out therefrom toward the waste ink foam 84 owing to the centrifugal force by the rotation of the cleaning roller 82 and gravity acted on its own weight. Further, the ink drops 89 remaining on the roller plane of the cleaning roller 82 are scraped off by the cleaning blade 83 and absorbed by the waste ink foam 84. Thus, the roller plane with no deposited ink drops 89 can be opposed to the nozzle plane 50 again.

As described above, in accordance with the cleaning device 80 according to this aspect, by bringing the cover plate 52 of the nozzle plane 50 of the ink jet recording head 39 having been slid into contact with the contact roller 81, the minute gap D is formed between the roller plane of the cleaning roller 82 and the nozzle plane 50. Further, by rotating the cleaning roller 82 with its roller plane being opposite to the nozzle plane 50 of the ink jet recording head 39, using the nature of the liquid moving toward the smaller contact angle direction, the ink drops 89 remaining on the nozzle plane 50 are moved to the roller plane of the cleaning roller 82. For this reason, the ink drops 89 deposited on the nozzle plane 50 of the ink jet recording head 39 can be scraped off in non-contact with the nozzle plane 50. Thus, it is possible to prevent the water repellent layer formed on the nozzle plane 50 of the ink jet recording head 39 from being worn down or damaged, thereby lengthening the product life of the ink jet recording head 39.

Additionally, in this aspect, as the cleaning member, the cleaning blade 83 is adopted. Instead of this, the roller with an absorptive material absorbing the ink drops 89 serving as the roller plane may be brought into contact with the cleaning roller 82 so that the ink drops 89 are removed from the roller plane of the cleaning roller 82.

What is claimed is:

1. A head cleaning device comprising:

an ink jet recording head including a nozzle plane formed with nozzles for ejecting ink;

a positioning member capable of being brought into contact with an area outside the nozzle plane; and a cleaning roller capable of defining a minute air gap between its roller plane and the nozzle plane and capable of rotating while facing the roller plane toward the nozzle plane;

wherein the cleaning roller cleans the nozzle plane in a state that the minute air gap is formed between the roller plane and the nozzle plane.

2. The head cleaning device according to claim 1, further comprising:

a cleaning member that removes the ink from the roller plane of the cleaning roller.

3. The head cleaning device according claim 2;

wherein the cleaning member comprises a blade being in slidable contact with the roller plane of the cleaning roller.

4. The head cleaning device according claim 2;

wherein the cleaning member is located on a downstream side in a rotating direction of the cleaning roller with respect to a lowest position of the roller plane of the cleaning roller.

5. The head cleaning device according to claim 1;

wherein the positioning member comprises a positioning roller capable of being brought into contact with the area outside the nozzle plane of the ink jet recording head; and wherein the head cleaning device further comprises a drive transmission member that rotates the cleaning roller reversely to the positioning roller on the basis of rotation of the positioning roller.

6. The head cleaning device according to claim 1;

wherein the roller plane of the cleaning roller is made of material more hydrophilic than that of the nozzle plane.

7. The head cleaning device according claim 1;

wherein the minute gap is within a range from 0.01 to 0.1 mm.

8. The head cleaning device according to claim 1, further comprising:

a driving mechanism that moves the ink jet recording head relative to the cleaning roller; and a drive transmission member that rotates the cleaning roller such that the nozzle plane of the ink jet head and the roller plane of the cleaning roller move in opposite directions while the positioning member is brought into contact with the area outside the nozzle plane.

9. A head cleaning device comprising:

a positioning roller capable of being brought into contact with an area outside a nozzle plane of an ink jet recording head and capable of rotating while contacting with the area; and a cleaning roller capable of defining a minute gap between its roller plane and the nozzle plane and capable of rotating while facing the roller plane toward the nozzle plane, a highest position of the roller plane being lower than that of the positioning roller.

10. The head cleaning device according to claim 9, further comprising:

a pair of support members that rotatably support the cleaning roller.

11. The head cleaning device according claim 10;

wherein the support member rotatably supports the positioning roller.

12. The head cleaning device according to claim 10, further comprising:

an ink absorbing member disposed between the pair of support members below the cleaning roller.

* * * * *